US006385823B1

(12) United States Patent
Yamaguchi et al.

(10) Patent No.: US 6,385,823 B1
(45) Date of Patent: May 14, 2002

(54) BUCKLE WITH NOISE PREVENTION MECHANISM

(75) Inventors: Yutaka Yamaguchi; Akihiro Shiota; Yoshihiko Kawai; Tadayuki Asako; Takaaki Kimura, all of Tokyo (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 09/642,467

(22) Filed: Aug. 21, 2000

(30) Foreign Application Priority Data

Aug. 26, 1999 (JP) ..... 11-239647

(51) Int. Cl.[7] ..... A44B 11/26
(52) U.S. Cl. ..... 24/641; 24/633
(58) Field of Search ..... 24/633, 640–642, 24/636–639

(56) References Cited

U.S. PATENT DOCUMENTS 4,577,378 A * 3/1986 Harenberg
4,597,141 A * 7/1986 Wier
4,703,542 A 11/1987 Hirata et al.
4,926,528 A * 5/1990 Matsuki
5,722,129 A * 3/1998 Harrison et al.

FOREIGN PATENT DOCUMENTS

| | | |
|---|---|---|
| DE | 2 037 316 | 3/1972 |
| DE | 24 17 408 | 1/1975 |
| DE | 31 28 139 | 1/1983 |
| DE | 34 22 692 | 2/1985 |
| DE | 85 23 708 | 12/1986 |

* cited by examiner

*Primary Examiner*—James R. Brittain
(74) *Attorney, Agent, or Firm*—Kanesaka & Takeuchi

(57) ABSTRACT

In a buckle for a seat belt, lower ends of side walls of an operational button is positioned at a level lower than lower ends of guide portions of a base, and an upper surface of a portion of a lower cover defining a tongue-insertion opening is positioned at a level higher than an upper surface of a bottom of the base. Therefore, when a tongue is engaged with the buckle, an engaging portion of the tongue touches at least one of the side walls of the operational button made of resin, and the portion of the lower cover made of resin. Thus, the tongue is prevented from touching the guide portions and the bottom of the base made of metal, thereby preventing a noise due to the metal-to-metal contact when the tongue 3 is inserted into the buckle and engaged with the buckle. Therefore, a jar on an occupant's nerve when wearing the seat belt can be avoided.

4 Claims, 6 Drawing Sheets

BUCKLE WITH NOISE PREVENTION MECHANISM

BACKGROUND OF THE INVENTION AND RELATED ART STATEMENT

The present invention pertains to a buckle used in a seat belt device provided for a seat of a vehicle, such as an automobile.

Currently, in various vehicles including automobiles, seat belt devices for protecting occupants in emergency, such as collision, are installed to seats thereof. In order to facilitate the occupant to wear on and off a seat belt, a buckle is normally provided. In general, the buckle comprises a latch member provided with a joggle portion which engages a tongue, wherein the latch member is biased by a spring in such a direction as to engage the tongue.

By the way, the buckle comprises a base made of metal having a U-shaped section composed of side walls and a bottom, wherein the base is attached to a cover made of resin and is accommodated in the cover, and components including the aforementioned latch member are supported by the side walls. When the tongue is inserted into a tongue-insertion opening of the buckle, the end of the tongue is guided by guiding portions formed on the side walls of the metal base having the U-shaped section.

However, in the conventional buckle of this type, when the tongue is inserted into the buckle and is engaged with the buckle, a portion of the tongue to be engaged with a latch member sometimes collides with the aforementioned guide portions and/or the bottom of the base. Since the engaging portion of the tongue is made of metal, the collision between the tongue and the guide portions or the bottom, which are made of metal, makes noise that may jar on an occupant's nerve who wears the seat belt.

The present invention has been made for solving the above problems, and an object of the present invention is to provide a buckle which can restrain such noise as little as possible that may be made when the tongue is engaged.

SUMARRY OF THE INVENTION

To solve the aforementioned problems, the present invention provides a buckle comprising at least: a base made of metal and having a U-shaped section composed of side walls and a bottom; a cover made of resin for housing the base and having a tongue-insertion opening; an operational member made of resin disposed at the tongue-insertion opening for releasing the engagement between a tongue and a latch member; and guide portions formed integrally with the inner surfaces of the side walls for guiding the end of the tongue when the tongue is inserted through the tongue-insertion opening. The tongue is engaged when the tongue is inserted and reaches a predetermined position, and is released from the buckle by release operation of the operational member.

In the invention, the tongue-insertion opening is defined by the cover and the operational member. A portion of the cover for defining the tongue-insertion opening projects for a predetermined distance into the path of movement of the tongue from a surface of the bottom of the base facing the path of the tongue, and a portion of the operational member for defining the tongue-insertion opening projects for a predetermined distance into the path of the tongue from the surfaces of the guide portions facing the path of the tongue. Thus, when the tongue is engaged with the buckle, the tongue touches or collides with at least either the portion of the cover or the portion of the operational member without touching or colliding with the bottom of the base and the guide portions.

In the buckle of the present invention structured as described above, when the tongue is inserted into the buckle through the tongue-insertion opening and is set in the latched state, the tongue touches or collides with the at least one of the portion of the cover made of resin for defining the tongue-insertion opening and the portion of the operational member made of resin for defining the tongue-insertion opening and is prevented from touching or colliding with the guide portions formed on the side walls and the bottom of the base made of metal.

Therefore, noise due to the metal-to-metal contact can be prevented.

DETAILED DESCRIPTION OF PREFERRED EMBODIMENT

Hereinafter, an embodiment of the present invention will be described with reference to the attached drawings.

Figure 1:
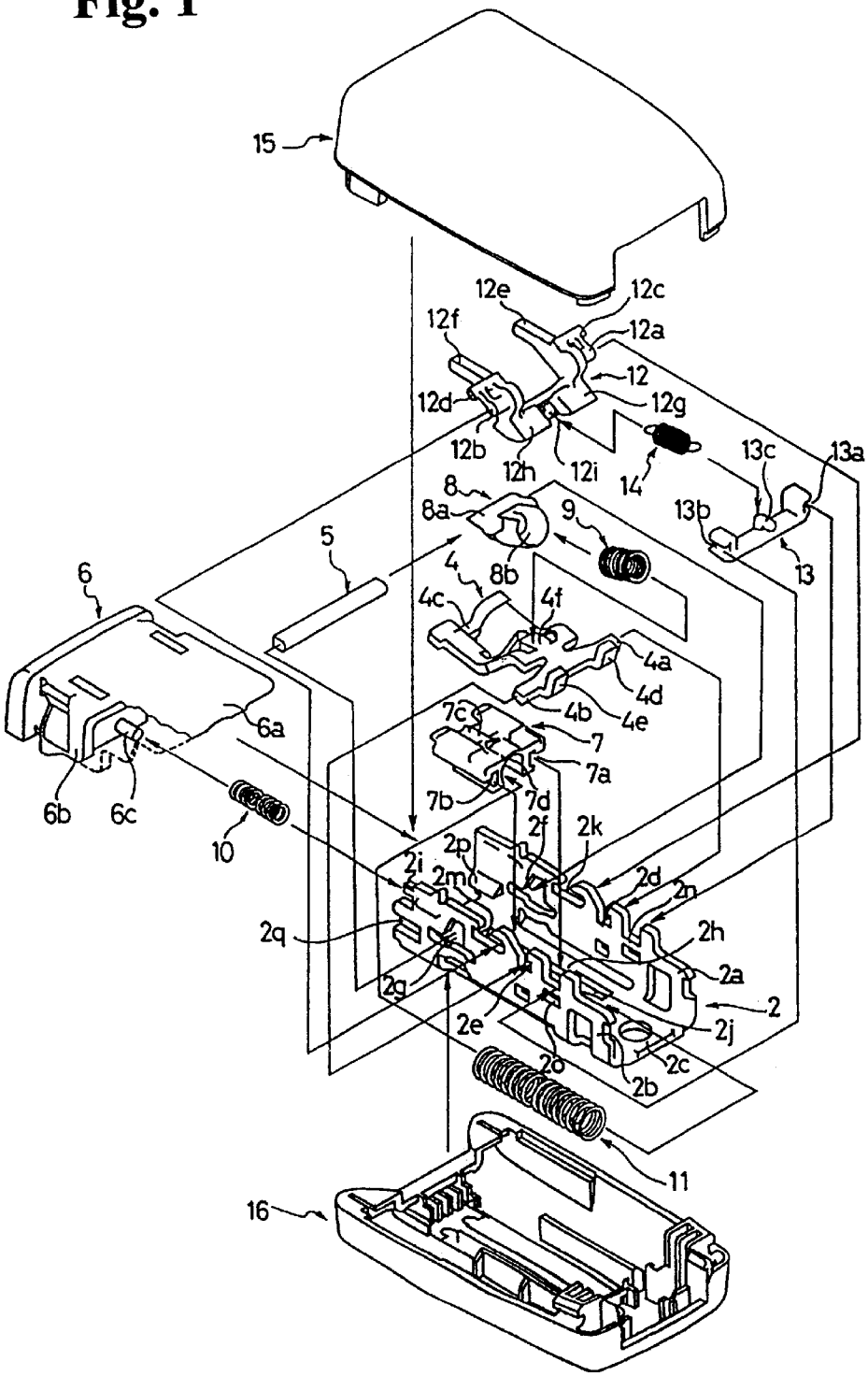
FIG. 1 is an exploded perspective view showing an embodiment of a buckle of the present invention.
Figure 2:
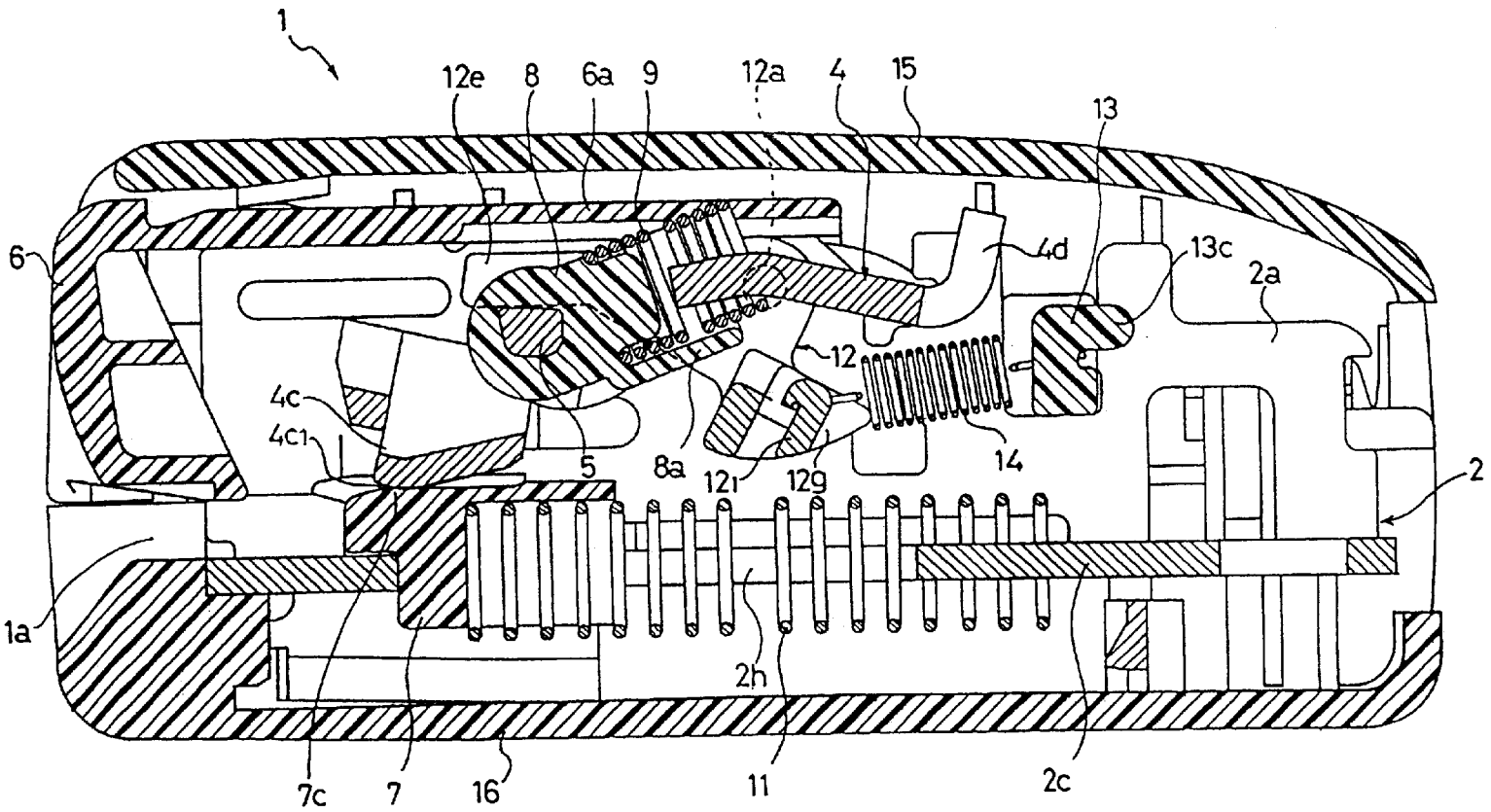
FIG. 2 is a sectional view showing the buckle of the embodiment in an unlatched state in which a tongue is not engaged.
Figure 3:
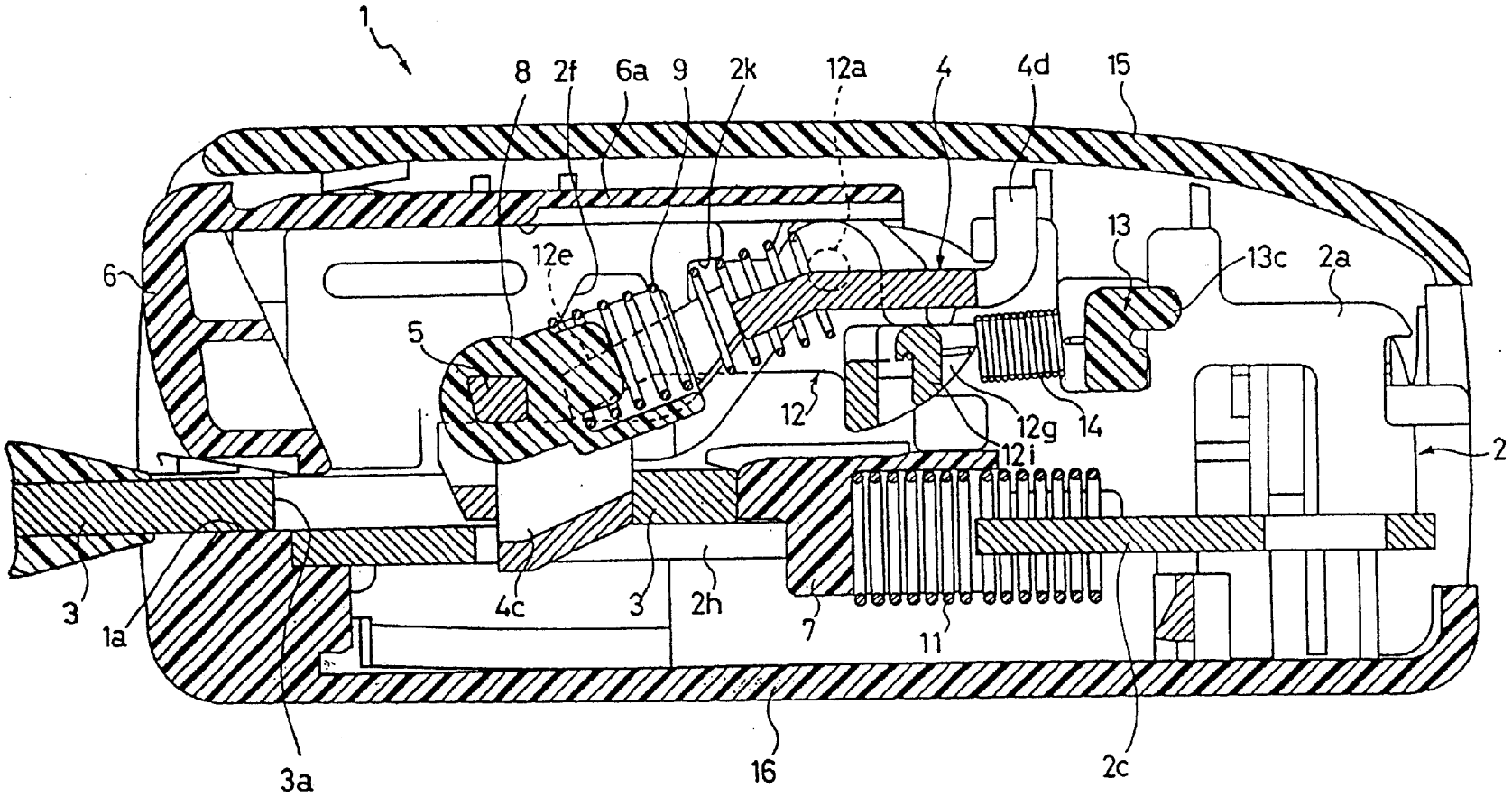
FIG. 3 is a sectional view showing the buckle of the embodiment in a latched state in which the tongue is engaged.
Figure 4:
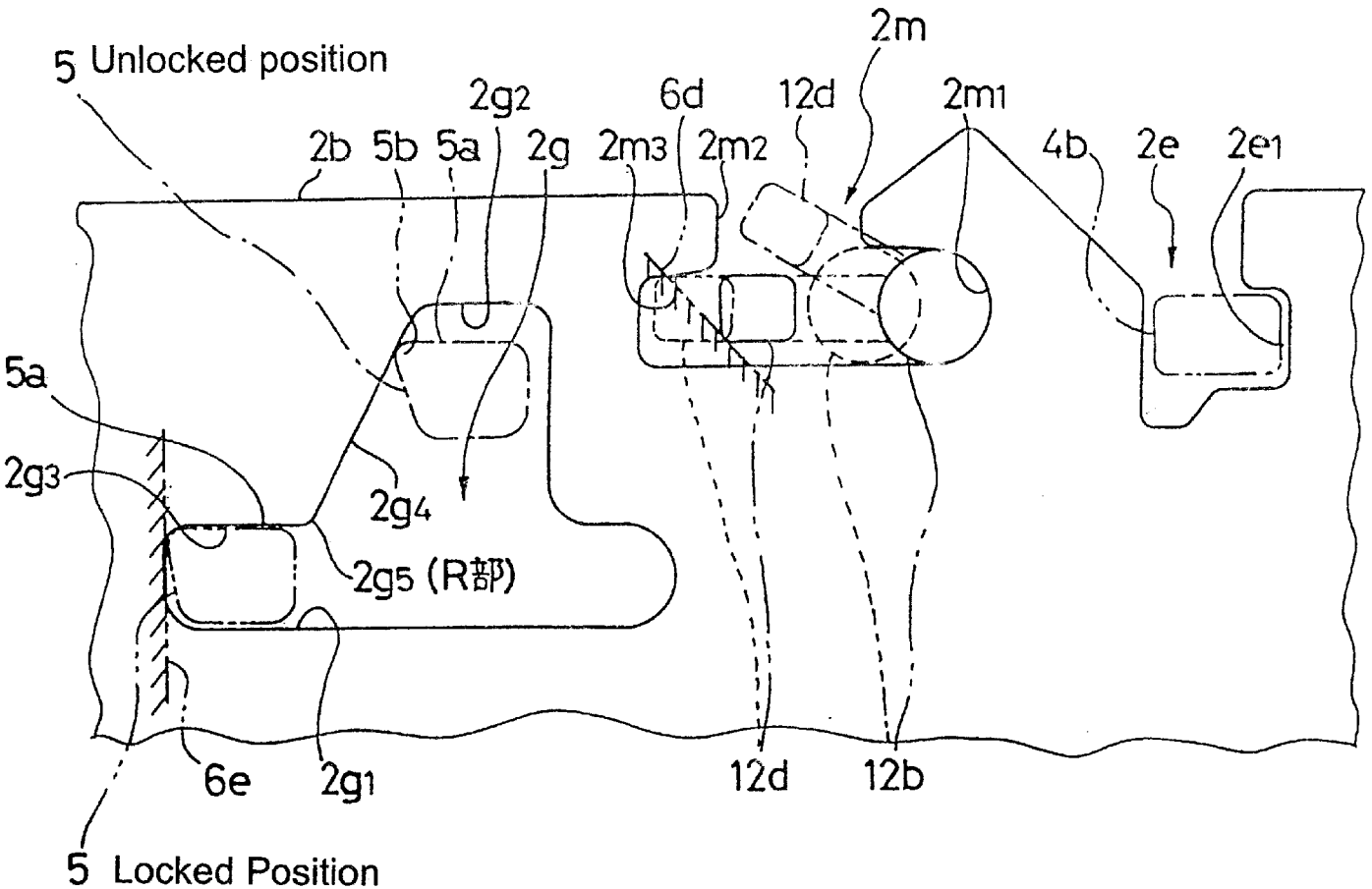
FIG. 4 is a view showing a guide hole, a supporting groove and a guide groove formed in a side wall of a base of the buckle of the embodiment.

FIG. 1 is an exploded perspective view showing an embodiment of a buckle of the present invention, FIG. 2 is a sectional view showing the buckle of the embodiment in an unlatched state in which a tongue is not engaged, FIG. 3 is a sectional view showing the buckle of the embodiment in the latched state in which the tongue is engaged, and FIG. 4 is a view showing a guide hole, a supporting groove and a guide groove formed in a side wall of a base of the buckle of the embodiment. It should be noted that the terms "right" and "left" used in the following description represent the right and the left in the drawings.

As shown in FIG. 1 through FIG. 4, the buckle 1 of the embodiment comprises a base 2 formed of a U-shaped frame having side walls 2*a*, 2*b* and a bottom 2*c*; a latch member 4 which is pivotally supported by the side walls 2*a*, 2*b* of the base 2 and can engage a tongue 3; a lock pin 5 for preventing the latch member 4 from moving in the unlatching direction while the tongue 3 is engaged with the latch member 4; an operational button 6 disposed to the side walls 2*a*, 2*b* of the base 2 in such a manner that the operational button 6 can move in the longitudinal direction of the base 2; an ejector 7 disposed on the bottom 2*c* of the base 2 in such a manner that the ejector 7 can slide in the longitudinal direction of the base 2 and can urge the tongue in a direction so as to be released from the buckle 1; a slider 8 having a lock-pin holding portion 8*a* for holding the lock pin 5; a slider spring 9 disposed between the slider 8 and the latch member 4 to always urge the slider 8 to press the lock pin 5 toward the latch member 4; a button spring 10 always urging the operational button 6; an ejector spring 11 always urging the ejector 7; an inertia lever member 12 which is pivotally supported by the side walls 2*a*, 2*b* of the base 2 in such a manner that it can move in the longitudinal direction of the base 2 and which prevents the lock pin 5 from moving due to inertia to the release position where the engagement between the tongue 3 and the latch member 4 is released; a spring holder 13 supported by and fixed to the side walls 2*a*, 2*b* of the base 2; a lever spring 14 which is disposed between the inertia lever member 12 and the spring holder 13 to pull each other; and an upper cover 15 and a lower cover 16 which are engaged with each other in such a manner that the base 2 on which the aforementioned components are assembled is covered from the top and the bottom.

The side walls 2*a*, 2*b* of the base 2 are provided with supporting grooves 2*d*, 2*e* for supporting shaft portions 4*a*, 4*b* of the latch member 4; inverted T-shaped guide holes 2*f*, 2*g* for supporting and guiding both end portions of the lock pin 5; a spring supporting portion 2*i* formed on one side wall 2*b* for supporting one end of the button spring 10; guide grooves 2*k*, 2*m* which support shaft portions 12*a*, 12*b* of the inertia lever member 12 in such a manner that the inertia lever member 12 can pivot and move in the longitudinal direction and which receive pressed portions 12*c*, 12*d* for returning the inertia lever member 12 from its operative position to its inoperative position by the depression of the operational button 6; receiving portions 2*n*, 2*o* in which mounting portions 13*a*, 13*b* of the spring holder 13 are fitted in such a manner as to allow the removal of the spring holder 13; and guide portions 2*p*, 2*q* for guiding the tongue 3 during the insertion of the tongue 3 into the buckle 1. In addition, the bottom 2*c* of the base 2 is provided with a guide rail 2*h* (another one is disposed symmetrically with the guide rail 2*h* relative to the longitudinal axis, but not shown) in which guide grooves 7*a*, 7*b* of the ejector 7 are slidably fitted and which guide the ejector 7 in the longitudinal direction, and a spring supporting portion 2*j* for supporting one end of the ejector spring 11.

The configurations of the supporting groove 2*e*, the inverted T-shaped guide hole 2*g* and the guide groove 2*m* formed in the side wall 2*b* are shown in FIG. 4. The supporting groove 2*e* has a shaft supporting portion 2*e*1 for pivotally supporting the shaft portion 4*b* of the latch member 4. The inverted T-shaped guide hole 2*g* comprises a longitudinal hole portion 2*g*1 extending in the longitudinal direction and a vertical hole portion 2*g*2 extending upwardly from a middle portion of the longitudinal hole portion 2*g*1. An upper portion of a left end of the longitudinal hole portion 2*g*1 is a lock-pin holding portion 2*g*3 for holding the upper side of the lock pin 5 to prevent the upward movement of the lock pin 5 when the lock pin 5 is in its locked position (shown by a two-dot chain line in FIG. 4). A left end edge of the vertical hole portion 2*g*2 is a guiding portion 2*g*4 for guiding the lock pin 5 when the lock pin 5 moves from the unlocked position (shown by a chain line in FIG. 4) from the locked position or moves vice versa. The guiding portion 2*g*4 is an inclined surface extending upwardly and rightwardly from the longitudinal hole portion 2*g*1. The intersection between the lock-pin holding portion 2*g*3 and guiding portion 2*g*4 is a rounded portion 2*g*5 formed in an arc shape, the radius of which is set preferably as small as possible.

The guide groove 2*m* comprises a shaft supporting portion 2*m*1 for supporting the shaft portions 12*b* of the inertia lever member 12, an opening 2*m*2 through which the pressed portion 12*d* of the inertia lever member 12 can pass as shown by a chain line in FIG. 4 when the inertia lever member 12 pivots between the inoperative position and the operative position, and a pivot preventing portion 2*m*3 for preventing the pivotal movement of the inertia lever member 12 into the inoperative position by the contact with the pressed portion 12*d* as shown by a two-dot chain line in FIG. 4 when the inertia lever member 12 moves due to inertia.

Supporting groove 2*d*, guide hole 2*f* and guide groove 2*k* formed in the side wall 2*a* are not shown in FIG. 4, but are formed in the same configurations as the supporting groove 2*e*, the guide hole 2*g*, and the guide groove 2*m*, respectively. Though the components of the guide hole 2*f* are not shown in FIG. 4, the components have a longitudinal hole portion 2*f*1, a vertical hole portion 2*f*2, a lock-pin holding portion 2*f*3, a guiding portion 2*f*4 and a rounded portion 2*f*5, and are referred to in the following description.

The latch member 4 comprises a joggle portion 4*c* which can engage the tongue 3, pressed portions 4*d*, 4*e* which can be pressed by an end opposite to the operational end of the operational button 6 to move the latch member 4 in a releasing direction when the tongue 3 and the buckle 1 are disengaged by the operational button 6, and a spring supporting portion 4*f* for supporting one end of the slider spring 9. The latch member 4 takes a non-latched position where the tongue 3 is not engaged with the latch member 4, and a latched position where the tongue 3 is engaged with the latch member 4. The latch member 4 can pivot about the shaft portions 4*a*, 4*b* between the non-latched position and the latched position.

The lock pin 5 is disposed such that the lower end thereof always contacts the top surface of the latch member 4. The lock pin 5 takes the aforementioned locked position, set by the spring force of the slider spring 9 where the lock pin 5 is positioned in the longitudinal hole portions 2*f*1, 2*g*1 of the inverted T-shaped guide holes 2*f*, 2*g* to lock the latch member 4 in the latched state while the latch member 4 engages the tongue 3, and the above unlocked position, set by the operating force of the operational button 6, where the lock pin 5 is positioned in the vertical hole portions 2*f*2, 2*g*2 of the inverted T-shaped guide holes 2*f*, 2*g* to release the engagement of the latch member 4 from the tongue 3. The unlocked position is located on the right side of the locked position. The lock pin 5 has a section formed in a substantially rectangular shape or a substantially inverse trapezoidal shape having a shorter bottom side. During the movement of the lock pin 5, one corner 5*b* of the lock pin 5 always touches the guiding portions 2*f*4, 2*g*4 or the rounded portions 2*f*5, 2*g*5 of the guide holes 2*f*, 2*g*, and the upper surface 5*a* of the lock pin 5 touches the holding portions 2*f*3, 2*g*3. The corner 5*b* has a rounded portion, the radius of which is set preferably as small as possible.

Figure 5B:
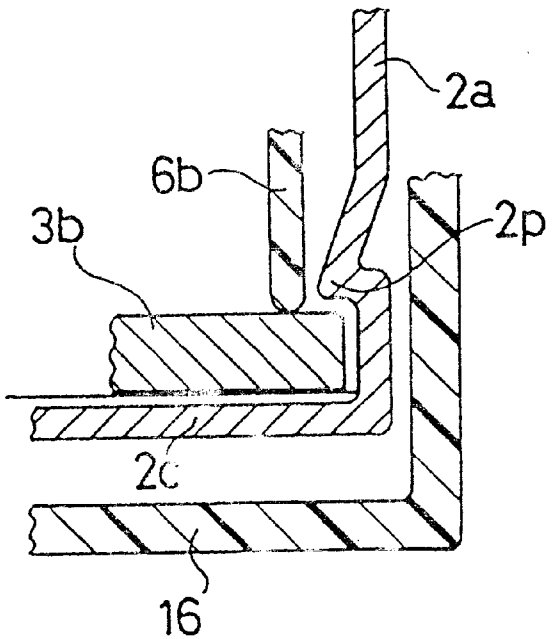
FIG. 5(*a*) is a partially sectional view showing the latched state of the buckle, and FIG. 5(*b*) is a sectional view taken along line 5(*b*)—5(*b*) of FIG. 5(*a*)
Figure 5A:
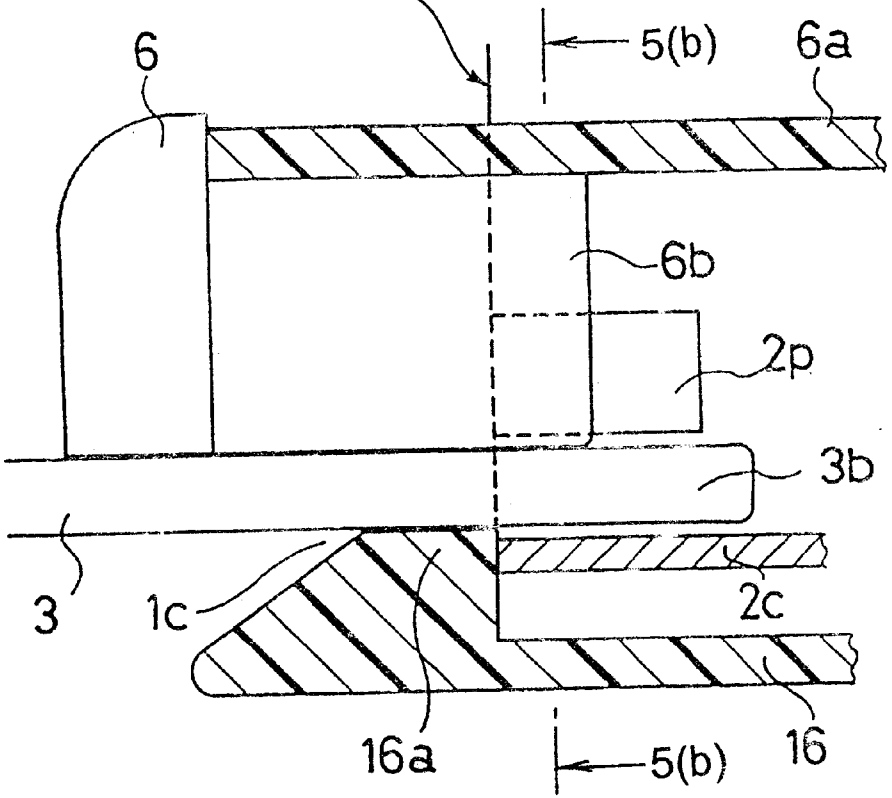
Figure 6A:
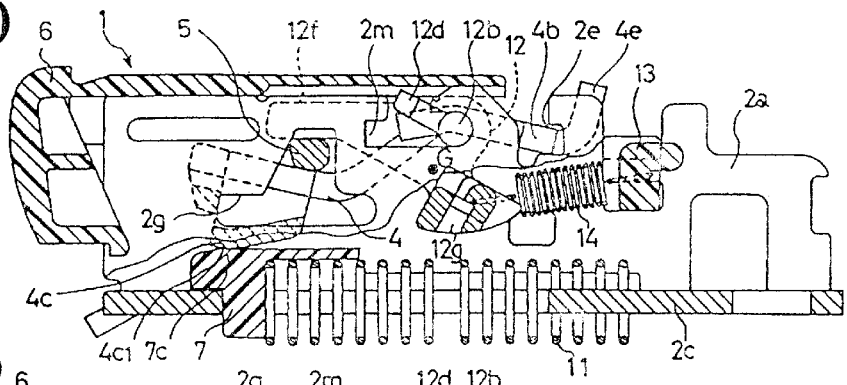
FIGS. 6(*a*)–6(*d*) are views for explaining an operation of the buckle of the embodiment for engaging the tongue, and an operation for preventing inertia release while the buckle and the tongue are engaged, wherein FIG. 6(*a*) is a view showing the unlatched state in which the tongue is not engaged with the buckle, FIG. 6(*b*) is a view showing the latched state in which the tongue is engaged with the buckle, FIG. 6(*c*) is a view showing the state when the buckle is pulled by the buckle pretensioner, and FIG. 6(*d*) is a view showing the state when the buckle is suddenly stopped at the end of a pretensioning movement by the buckle pretensioner.
Figure 6B:
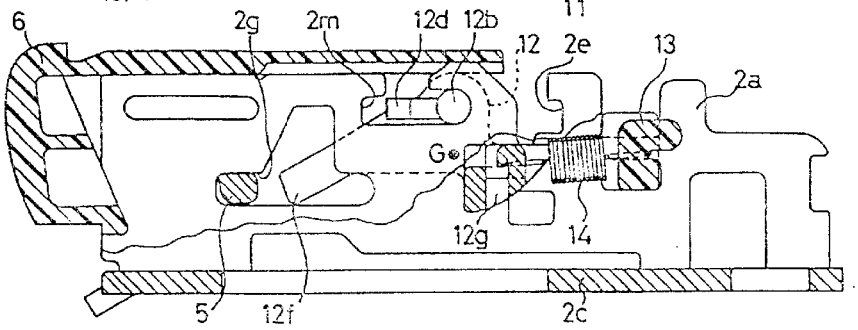
Figure 6C:
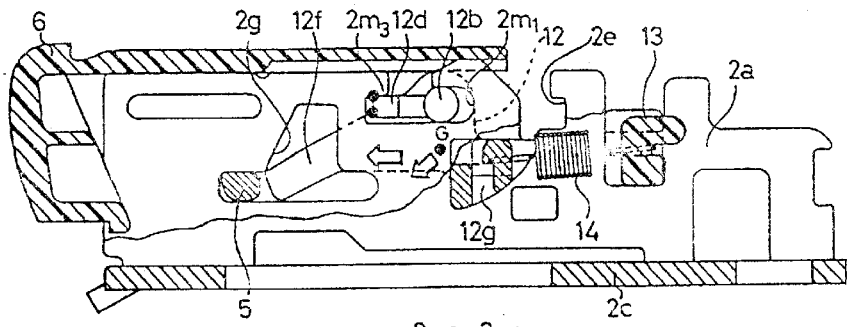
Figure 6D:
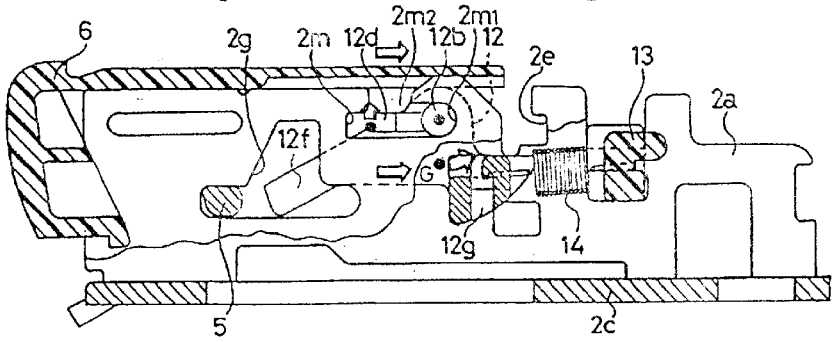

The operational button 6 comprises a plane portion 6*a* extending in the longitudinal direction and in the width direction, side walls 6*b* (one side wall is not shown in FIG. 1 and is formed in the same manner as the side wall 6*b*. For convenience of explanation, numeral 6*b* designates both side walls.) formed perpendicularly to the plane portion 6*a* and thus disposed on both side edges of the plane portion 6*a*, and a spring supporting portion 6*c* disposed at a position shifted to one side from the center along the longitudinal direction for supporting the other end of the button spring 10. In this case, as for a part of the operational button 6, the plane portion 6*a* and the side walls 6*b* of the operational button 6 form together an inverted U-shaped cross-section as shown in FIG. 2 and FIG. 3. As for the other part of the operational button 6, the plane portion 6*a* extend to the right side beyond the position of the shaft portions 12*a*, 12*b* of the inertia lever member 12. The side wall 6*b* has a length such that a part of the side wall 6*b* is overlapped with a part of the guide portion 2*p* or 2*q* when the operational button 6 is inoperative and a height such that the lower end of the side wall 6*b* is positioned at a level lower than that of the guide portion 2*p* or 2*q* by a predetermined distance as shown in FIG. 5(*a*) and FIG. 5(*b*).

Disposed inside the side walls 6*b* of the operational button 6 are inertia lever operating portions, not shown in FIG. 1 through FIG. 3, comprising inclined surfaces which press the pressed portions 12*c*, 12*d* of the inertia lever member 12 in such a manner as to move the inertia lever member 12 from the operative position to the inoperative position (schematically shown in FIG. 4 as an inertia lever operating portion 6*d*). Also, disposed inside the side walls 6*b* of the operational button 6 are lock pin operating portions, also not shown in FIG. 1 through FIG. 3, comprising vertical surfaces which press the both end portions of the lock pin 5 to move the lock pin 5 from the locked position to the unlocked position (schematically shown in FIG. 4 as a lock pin operating portion 6*e*).

In this embodiment, as the operational button 6 is operated to move to the right for releasing the state in which the tongue 3 and the buckle 1 are engaged, the inertia lever operating portions 6*d* contacts the pressed portions 12*c*, 12*d* of the inertia lever member 12 to press the pressed portions 12*c*, 12*d* toward the inoperative position of the inertia lever member 12, and then, the lock pin operating portions 6*e* contact the lock pin 5 to move the lock pin 5 toward its unlocked position.

The ejector 7 comprises a protrusion 7*c* which is disposed along the longitudinal center thereof, and has a point-contact with the joggle portion 4*c* of the latch member 4, and a spring supporting portion 7*d* for supporting the other end of the ejector spring 11.

The slider 8 comprises a spring supporting portion 8*b* for supporting the other end of the slider spring 9.

The inertia lever member 12 composes a shock-proof system for preventing the movement of the lock pin 5 and the operational button 6 into their release positions due to inertia while the tongue 3 and the buckle 1 are engaged. The inertia lever member 12 comprises levers 12*e*, 12*f*, mass bodies 12*g*, 12*h* which have a center of gravity G substantially perpendicular to the extension direction of the levers 12*e*, 12*f*, and a spring supporting portion 12*i* for supporting one end of the lever spring 14. In this case, the mass of the mass bodies 12*g*, 12*h* is designed in such a manner that the moment about the shaft portions 12*a*, 12*b* produced by the inertia force acting on the center of gravity G of the mass bodies 12*g*, 12*h* due to inertia is larger than the moment around the shaft portions 12*a*, 12*b* produced by the force of the inertia lever operating portions 6*d* for pressing the pressed portions 12*c*, 12*d* of the inertia lever member 12 toward the inoperative position of the inertia lever member 12 due to the inertia movement of the operational button 6 in the releasing direction.

The spring holder 13 comprises a spring supporting portion 13*c* for supporting the other end of the lever spring 14.

The lower cover 16 has a portion 16*a* defining a tongue-insertion opening 1*a* of the buckle 1. As shown in FIGS. 5(*a*) and 5(*b*), in the condition that the lower cover 16 is assembled with the base 2, the upper surface of the portion 16*a* of the lower cover 16 is positioned at a level higher than the upper surface of the bottom 2*c* of the base 2 by a predetermined distance.

Among the aforementioned components, the operational button 6, the ejector 7, the slider 8, the spring holder 13, the upper cover 15, and the lower cover 16 are made of resin, and the other components and an engaging portion 3*b* of the tongue 3 are made of metal.

Though there is no illustration in any of the drawings, a known buckle pretensioner is connected to the base 2 of the buckle 1. The buckle pretensioner is actuated in case of emergency, such as a vehicle collision, to rapidly pull the base 2 to the right in the drawings, whereby the seat belt can quickly restrain a vehicle occupant.

Hereinafter, description will be made as regard to the action of the buckle 1 of this embodiment structured as mentioned above for engaging the tongue 3 and the action of the shock proof system composed of the inertia lever member 12 for preventing an unexpected release due to inertia (hereinafter, referred to as "the inertia release").

FIGS. 6(*a*)–6(*d*) are views for explaining the action of the buckle of this embodiment for engaging the tongue and the action for preventing the inertia release while the buckle and the tongue are engaged, wherein FIG. 6(*a*) is a view showing the unlatched state in which the tongue is not engaged with the buckle, FIG. 6(*b*) is a view showing the latched state in which the tongue is engaged with the buckle, FIG. 6(*c*) is a view showing the state when the buckle is pulled by the buckle pretensioner, and FIG. 6(*d*) is a view showing the state when the buckle is suddenly stopped at the end of pretensioning movement by the buckle pretensioner. For convenience of explanation, sections are irregularly shown, and illustrations of the components not directly related to the following description are partially omitted.

In the unlatched state of the buckle 1 in which the tongue 3 is not engaged, as shown in FIG. 2 and FIG. 6(*a*), the ejector 7 is set in its left-most position by the spring force of the ejector spring 11. In this left-most position of the ejector 7, the ejector 7 presses the joggle portion 4*c* of the latch member 4 so that the bottom 4*c*1 of the joggle portion 4*c* of the latch member 4 is in point-contact with the protrusion 7*c* formed on the top of the ejector 7. In this state, the latch member 4 is out of the path for the tongue 3, that is, in the unlatched position where it does not engage the tongue 3. At this point, the lock pin 5 is in contact with the upper surface of the latch member 4 and is thus lifted by the latch member 4, so that the lock pin 5 is set in the unlocked position in the vertical hole portions 2*f*2, 2*g*2 of the inverted T-shaped holes 2*f*, 2*g*. In this unlatched state of the buckle 1, since the levers 12*e*, 12*f* of the inertia lever member 12 are mounted on the lock pin 5 and the lock pin 5 is lifted to be located at the unlocked position, the levers 12*e*, 12*f* of the inertia lever member 12 are set in the inoperative position as shown by dotted lines of FIG. 6(*a*). Because of the spring force of the lever spring 14 acting rightward, the inertia lever member 12 is in the state in which the shaft portions 12*a*, 12*b* thereof are in contact with the shaft supporting portions 2*k*1, 2*m*1 of the guide grooves 2*k*, 2*m*.

As the tongue 3 is inserted into the buckle 1 through the tongue-insertion opening 1*a* formed in the left end of the buckle 1 in the unlatched state of the buckle 1 shown in FIG. 2 and FIG. 6(*a*), the right end of the tongue 3 abuts against the left end of the ejector 7 and then presses the ejector 7 rightward. Accordingly, the ejector 7 moves to the right so as to compress the ejector spring 11 according to the insertion of the tongue. By the movement of the ejector 7, the joggle portion 4*c* mounted on the protrusion 7*c* of the ejector 7 comes off the ejector 7. Since the lock pin 5 is pressed down by the spring force of the slider spring 9 via the slider 8 and the lock pin 5 presses in turn the joggle portion 4*c* of the latch member 4, the latch member 4 pivots about the shaft portions 4*a*, 4*b* in the counter-clockwise direction in the drawings. Therefore, the joggle portion 4*c* of the latch member 4 enters into the path for the tongue 3 and is inserted into the engaging hole 3*a* of the tongue 3, so that the latch member 4 comes to the latched position. As the operating force for insertion applied to the tongue 3 is stopped, the ejector 7 presses the right end of the tongue 3 by the spring force of the ejector spring 11, whereby the right end portion of the engaging hole 3*a* of the tongue 3 is engaged with the joggle portion 4*c*. As a result of this, the tongue 3 is engaged with the buckle 1, that is, the buckle 1 becomes in its latched state as shown in FIG. 3 and FIG. 6(*b*).

During this, the lock pin 5 is guided by the guiding portions 2*f*4, 2*g*4, i.e. the inclined surfaces, to move down in the vertical hole portions 2*f*2, 2*g*2 to enter into the longitudinal hole portions 2*f*1, 2*g*1 and move to the left, i.e. into the locked position. In the locked position of the lock pin 5, since the upper side of the lock pin 5 is held by the lock-pin holding portions 2*f*3, 2*g*3, the upward movement of the lock pin 5 is prevented. Therefore, the lock pin 5 keeps the latch member 4 in the latched position, thereby preventing the latch member 4 from coming off the engaging hole 3*a* of the tongue 3 and thus securely keeping the engagement between the tongue 3 and the buckle 1.

In this latched state of the buckle 1 in which the tongue 3 is engaged, since the spring supporting portion 12*i* of the inertia lever member 12 is pulled by the spring force of the lever spring 14, the inertia lever member 12 pivots about the shaft portions 12*a*, 12*b* supported by the shaft supporting portions 2*k*1, 2*m*1 in the counter-clockwise direction. As shown in FIG. 6(*b*), therefore, the ends of the levers 12*e*, 12*f* enter into the path of the lock pin 5 for moving into the unlocked position, and the pressed portions 12*c*, 12*d* are in such a position capable of passing through the openings 2*k*2, 2*m*2, so that the inertia lever member 12 is in the operative position. In the operative position of the inertia lever member 12, even when the lock pin 5 tends to move to the unlocked position, the lock pin 5 comes in contact with the lever 12*e*, 12*f*, thereby preventing the movement of the lock pin 5 to the unlocked position.

In this manner, the engagement between the tongue 3 and the buckle 1 can be securely conducted and can be securely prevented from releasing.

To release the engagement between the tongue 3 and the buckle 1, as the operational button 6 is pressed to the right, the operational button 6 moves to the right, and as described above, the inertia lever operating portions 6*d* of the operational button 6 press the pressed portions 12*c*, 12*d* of the inertia lever member 12 toward the inoperative position, so that the inertia lever member 12 pivots about the shaft portions 12*a*, 12*b* in the clockwise direction in such a manner that the pressed portions 12*c*, 12*d* pass through the openings 2*k*2, 2*m*2. Accordingly, the ends of the levers 12*e*, 12*f* move upwardly above the path of the lock pin 5 for moving in the longitudinal direction.

As the operational button 6 further moves to the right from this state, the lock pin operating portions 6*e* move the lock pin 5 to the right. When the lock pin 5 arrives at a position for allowing the shifting of the lock pin 5 into the vertical hole portions 2*f*2, 2*g*2, the lock pin 5 is no longer held by the lock-pin holding portions 2*f*3, 2*g*3, so that the latch member 4 is allowed to pivot about the shaft portions 4*a*, 4*b* in the clockwise direction. At this point, the lock pin 5 is positioned just below the levers 12*e*, 12*f*. Since the lock pin 5 is not held by the lock-pin holding portions 2*f*3, 2*g*3 and the ejector 7 is urged in the releasing direction by the spring force of the ejector spring 11, the ejector 7 springily presses up the latch member 4, so that the latch member 4 pivots about the shaft portions 4*a*, 4*b* in the clockwise direction. As a result, the joggle portion 4*c* comes off the engaging hole 3*a* of the tongue 3 and the tongue 3 is pushed out to the left. At this point, the lock pin 5 is lifted up by the latch member 4 according to the pivot movement of the latch member 4 in the clockwise direction and thus enters into the vertical hole portions 2*f*2, 2*g*2. In addition, the lock pin 5 presses up the levers 12*e*, 12*f*, so that the inertia lever member 12 pivots about the shaft portions 12*a*, 12*b* in the clockwise direction.

Then, the bottom 4*c*1 of the joggle portion 4*c* of the latch member 4 is mounted on the protrusion 7*c* of the ejector 7. Finally, the ejector 7 comes to the left-most position, the latch member 4 comes to the unlatched position, the lock pin 5 comes to the unlocked position, and the inertia lever member 12 comes to the inoperative position, so that the buckle 1 comes to the unlatched state in which the tongue 3 is released as shown in FIG. 2 and FIG. 6(*a*).

Hereinafter, description will be made as regard to the operation of the shock proof system by the inertia lever member 12.

As the buckle pretensioner is actuated in case of emergency, such as a vehicle collision, when the seat belt is worn, i.e. when the buckle 1 is in the latched state in which the tongue 3 is engaged as shown in FIG. 3 and FIG. 6(*b*), the base 2 is suddenly pulled to the right. Consequently, extremely large rightward acceleration is exerted to the buckle 1, that is, the buckle 1 is subjected to a large leftward inertia force. At this point, the inertia lever member 12 is allowed to move to the left and to pivot in the clockwise direction. Therefore, while the buckle 1 is being pulled by the buckle pretensioner, as shown in FIG. 6(*c*), only the inertia lever member 12 moves to the left due to its inertia force acting on the center of gravity G, whereby the pressed portions 12*c*, 12*d* of the inertia lever member 12 are quickly positioned below the pivot preventing portions 2*k*3, 2*m*3. Though, at this point, the inertia lever member 12 tends to pivot in the counter-clockwise direction due to the inertia force acting on the center of gravity G of the mass bodies 12*g*, 12*h*, the ends of the pressed portions 12*c*, 12*d* come in contact with the pivot preventing portions 2*k*3, 2*m*3, whereby the inertia lever member 12 is prevented from pivoting.

At the end of the pretensioning movement by the buckle pretensioner, the buckle is suddenly stopped from this state, so that a large inertia force is exerted to the buckle 1 in a direction opposite to the direction of the inertia force exerted while the buckle 1 is being pulled (i.e. in the rightward direction). As shown in FIG. 6(*d*), therefore, the inertia lever member 12 moves to the right, so that the shaft portions 12*a*, 12*b* are returned to be supported by the shaft supporting portions 2*k*1, 2*m*1. In this state, the operational button 6 also moves to the right due to its inertia, so that the inertia lever operating portions 6*d* collide with the pressed portions 12*c*,

12*d* to press the pressed portions 12*c*, 12*d* in the diagonally upward direction by the inclined surfaces thereof. The inertia force of the operational button 6 produces a moment for rotating the inertia lever member 12 in the clockwise direction. On the other hand, at the same time, the inertia force acting on the center of gravity G of the mass bodies 12*g*, 12*h* produces a moment for rotating the inertia lever member 12 in the counter-clockwise direction. Since the mass bodies 12*g*, 12*h* are designed in such a manner that the moment in the counter-clockwise direction produced by the inertia force acting on the center of gravity G of the mass bodies 12*g*, 12*h* is larger than the moment in the clockwise direction produced by the inertia force of the operational button 6, the inertia lever member 12 does not pivot, so that the levers 12*e*, 12*f* are prevented at the end of the pretensioning movement from coming off the path of the lock pin 5 for moving in the longitudinal direction. Therefore, even when the lock pin 5 tends to move to the right, i.e. to the unlocked position, due to the inertia force at the end of the pretensioning travel, the lock pin 5 comes in contact with the ends of the levers 12*e*, 12*f* and is thereby prevented from moving into the unlocked position. In this manner, the inertia release of the tongue 3 due to the actuation of the buckle pretensioner can be prevented, so that the engagement between the tongue 3 and the buckle 1 can be held securely and strongly.

By the way, the buckle 1 of this embodiment is structured such that the lower ends of the side walls 6*b* of the operational button 6, i.e. the ends of the side walls 6*b*, facing the path of movement of the tongue 3 are positioned at a level lower, i.e. at a side of the path of the tongue 3, than the lower ends of the guide portions 2*p*, 2*q* by a predetermined distance, and that the upper surface of the portion 16*a* of the lower cover 16 defining the tongue-insertion opening, i.e. the surface of the portion 16*a* of the lower cover 16 facing the path of movement of the tongue 3, is positioned at a level higher, i.e. at a side of the path of the tongue 3, than the upper surface of the bottom 2*c* of the base 2, i.e. the surface of the bottom 2*c* facing the path of the tongue 3. Therefore, when the tongue 3 is engaged with the buckle 1, as shown in FIGS. 5(*a*) and 5(*b*), the engaging portion 3*b*, made of metal, of the tongue 3 touches or collides with at least one of the side walls 6*b* of the operational button 6 made of resin and the portion 16*a* of the lower cover 16 made of resin, but is prevented from touching or colliding with the guide portions 2*p*, 2*q* made of metal and the bottom 2*c* of the base 2 made of metal, thereby preventing a noise due to metal-to-metal contact when the tongue 3 is inserted into the buckle 1 and engaged with the buckle 1. Therefore, a jar on an occupant's nerve when wearing the seat belt can be avoided.

As apparent from the above description, according to the present invention, the buckle of the present invention is structured such that the engaging portion of the tongue touches or collides with at least one of a portion of the cover made of resin for defining the tongue-insertion opening and a portion of the operational member made of resin for defining the tongue-insertion opening, and is prevented from touching or colliding with the guide portions made of metal and a bottom of the base made of metal, thereby preventing a noise due to the metal-to-metal contact. Therefore, a jar on an occupant's nerve when wearing a seat belt can be avoided.

While the invention has been explained with reference to the specific embodiment of the invention, the explanation is illustrative and the invention is limited only by the appended claims.

What is claimed is:

1. A buckle comprising:

a base made of metal and having a U-shaped section formed of first side walls and a bottom, said first side walls having guide portions on inner surfaces thereof for guiding a tongue when the tongue is inserted therein;

a latch mechanism disposed on the base for latching the tongue to the buckle;

a cover made of resin for housing the base and having a lower cover for defining a tongue-insertion opening, said lower cover having an inlet portion for defining a part of the tongue-insertion opening, said inlet portion projecting upwardly for a predetermined distance into a path for the tongue from a surface of the bottom of the base facing the path for the tongue; and an operational member made of resin for releasing an engagement of the latch member with the tongue, said operation member being disposed in the cover to define the tongue-insertion opening together with the inlet portion and having two second side walls as an opening forming portion defining a part of the tongue-insertion opening, said second side walls being located between the first side walls adjacent thereto and projecting for a predetermined distance into the path for the tongue from lower surfaces of the guide portions facing the path so that when the tongue is inserted into buckle, the tongue touches at least one of the inlet portion of the cover and the second side walls of the operational member without touching the bottom of the base and the guide portions to prevent a noise in inserting the tongue.

2. A buckle according to claim 1, wherein said cover includes a plane portion, said second side walls extending downwardly from two sides of the plane portion.

3. A buckle according to claim 1, wherein said second side walls are arranged to be spaced apart from each other and integrally formed with the operational member so that the second side walls do not substantially deform when the tongue is inserted into the buckle.

4. A buckle according to claime 3, wherein said path is defined between the inlet portion and lower surfaces of the second side walls.

* * * * *